US006854695B1

(12) United States Patent
Kop

(10) Patent No.: US 6,854,695 B1
(45) Date of Patent: Feb. 15, 2005

(54) TOOL POUCH FRAME

(76) Inventor: Victor A. Kop, 807 Robinson Street Apartment A, Burlington, ON (CA), L7R 2L4

( * ) Notice: Subject to any disclaimer, the term of this patent is extended or adjusted under 35 U.S.C. 154(b) by 0 days.

(21) Appl. No.: 10/402,439

(22) Filed: Mar. 28, 2003

(51) Int. Cl.[7] ..... A45F 5/00

(52) U.S. Cl. ..... 248/97; 248/346.03; 248/95

(58) Field of Search ..... 482/24, 38, 104; 248/97, 205.2, 346.03, 95, 153, 175; 211/70.6; 224/251, 904

(56) References Cited

U.S. PATENT DOCUMENTS

| | | | | | |
|---|---|---|---|---|---|
| 2,618,419 | A | * | 11/1952 | Vanish | 224/666 |
| 3,095,172 | A | * | 6/1963 | Dwyer | 248/97 |
| 3,352,520 | A | * | 11/1967 | Bumgarner et al. | 248/99 |
| 3,438,506 | A | * | 4/1969 | Groth | 211/4 |
| RE26,606 | E | * | 6/1969 | Dodge | 482/38 |
| 3,598,350 | A | * | 8/1971 | Kaufman | 248/97 |
| 4,790,461 | A | * | 12/1988 | Stover | 224/241 |
| 5,664,712 | A | * | 9/1997 | Smrt | 224/250 |
| 5,961,427 | A | * | 10/1999 | Habing et al. | 482/96 |
| 5,992,716 | A | * | 11/1999 | Riley | 224/251 |
| 6,027,433 | A | * | 2/2000 | Flynn | 482/98 |
| 6,176,403 | B1 | * | 1/2001 | Svare et al. | 224/251 |
| 6,402,002 | B1 | * | 6/2002 | Benton | 224/600 |
| 6,499,637 | B1 | * | 12/2002 | Zamarron | 224/251 |
| 2002/0030071 | A1 | * | 3/2002 | Griffiths | 224/251 |

* cited by examiner

*Primary Examiner*—Ramon D. Ramirez
*Assistant Examiner*—Ingrid Weinhold

(57) ABSTRACT

Tool pouch frames support a tool pouch in an upright position and hold tools. The tool pouch frame comprises a U-shaped base, U-shaped upper member, and an inverted J-shaped front member connected to the exterior of the tool pouch by straps with side release buckles. The base ensures that the tool pouch cannot fall over and spill, even when it is heavily loaded. The tool pouch frame also holds frequently used tools in a position where they are easily accessed using rings with hook and loop fasteners. In addition, the front member acts as a convenient carrying handle for the tool pouch.

9 Claims, 2 Drawing Sheets

TOOL POUCH FRAME

BACKGROUND OF THE INVENTION

1. Field of the Invention

The present invention relates to a tool pouch frame for use in connection with a tool pouch. The tool pouch frame has particular utility in connection with supporting a tool pouch in an upright position and holding tools.

2. Description of the Prior Art

Tool pouch frames are desirable for supporting a tool pouch in an upright position and holding tools. The tool pouch frame ensures that the tool pouch cannot fall over and spill, even when it is heavily loaded. The tool pouch frame also holds frequently used tools in a position where they are accessible. In addition, the tool pouch frame increases the visibility of the interior of a tool pouch, thereby facilitating the location of a particular tool. The carrying capacity of a tool pouch is also maximized through use of a tool pouch frame. Furthermore, the tool pouch frame provides a convenient carrying handle for the tool pouch.

The use of tool holders for buckets is known in the prior art. For example, U.S. Pat. No. 4,993,551 to Lindsay discloses a tool holder for bucket. However, the Lindsay '551 patent does not have a frame, and has further drawbacks of requiring a bucket.

U.S. Pat. No. 5,429,265 to Maire et al. discloses a cover for bucket mounted tool carrier that is useful as a seat and an object holder. However, the Maire et al. '265 patent does not function without a bucket, and additionally does not have straps.

Similarly, U.S. Pat. No. Des. 345,237 to Stein discloses a tool pouch for bucket that covers a bucket. However, the Stein '237 patent does not have a frame, and cannot function without a bucket.

In addition, U.S. Pat. No. 4,765,472 to Dent discloses a bucket attachment tool holder that mounts on a conventional bucket having a loop handle. However, the Dent '472 patent does not have a frame, and also does not function without a bucket.

Furthermore, U.S. Pat. No. 5,649,623 to Komblatt discloses a ladder mounted tool belt carrier that holds articles on a ladder. However, the Komblatt '623 patent does not function without a ladder, and further lacks a frame.

Lastly, U.S. Pat. No. 6,193,122 to Buckley discloses a rigid frame tool belt assembly that suspends one or more multiple tool holders. However, the Buckley '122 patent does not have rings, and has the additional deficiency of requiring that a belt be worn around the waist.

While the above-described devices fulfill their respective, particular objectives and requirements, the aforementioned patents do not describe a tool pouch frame that allows supporting a tool pouch in an upright position and holding tools. The Lindsay '551 patent, the Stein '237 patent, the Dent '472 patent, and Komblatt '623 patent make no provision for a frame. The Lindsay '551 patent, the Maire et al. '265 patent, the Stein '237 patent, and the Dent '472 patent require a bucket. The Maire et al. '265 patent does not have straps. T he Komblatt '623 patent requires a ladder. The Buckley '122 patent does not have rings, and has the additional deficiency of requiring that a belt be worn around the waist.

Therefore, a need exists for a new and improved tool pouch frame that can be used for supporting a tool pouch in an upright position and holding tools. In this regard, the present invention substantially fulfills this need. In this respect, the tool pouch frame according to the present invention substantially departs from the conventional concepts and designs of the prior art, and in doing so provides an apparatus primarily developed for the purpose of supporting a tool pouch in an upright position and holding tools.

SUMMARY OF THE INVENTION

In view of the foregoing disadvantages inherent in the known types of tool holders for buckets now present in the prior art, the present invention provides an improved tool pouch frame, and overcomes the above-mentioned disadvantages and drawbacks of the prior art. As such, the general purpose of the present invention, which will be described subsequently in greater detail, is to provide a new and improved tool pouch frame which has all the advantages of the prior art mentioned heretofore and many novel features that result in a tool pouch frame which is not anticipated, rendered obvious, suggested, or even implied by the prior art, either alone or in any combination thereof.

To attain this, the present invention essentially comprises a base connected at either end to an upright member and a front member connecting the middle of the base to the middle of the upright member.

There has thus been outlined, rather broadly, the more important features of the invention in order that the detailed description thereof that follows may be better understood and in order that the present contribution to the art may be better appreciated.

The invention may also include the base and upright member being U-shaped. The front member may be in the shape of an inverted J. A lateral support may be connected to the opposing sides of the upright member. A plurality of ring attachments holding rings may be attached to the sides of the upright member. The opposing ends of the rings may be removably connected by ring end connection devices. The ring end connection devices may be hook and loop fasteners. The base, upright member, front member, and lateral support may be made of plastic, steel, aluminum, titanium, wood, or carbon fiber composite. There may be a handle attached to the front member. The invention may be an improvement to a tool bag. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tool pouch frame that has all of the advantages of the prior art tool holders for buckets and none of the disadvantages.

It is another object of the present invention to provide a new and improved tool pouch frame that may be easily and efficiently manufactured and marketed.

An even further object of the present invention is to provide a new and improved tool pouch frame that has a low cost of manufacture with regard to both materials and labor, and which accordingly is then susceptible of low prices of sale to the consuming public, thereby making such tool pouch frame economically available to the buying public.

Still another object of the present invention is to provide a new tool pouch frame that provides in the apparatuses and methods of the prior art some of the advantages thereof, while simultaneously overcoming some of the disadvantages normally associated therewith.

Even still another object of the present invention is to provide a tool pouch frame for supporting a tool pouch in an upright position and holding tools. This allows the tool pouch frame to be secured to a tool pouch.

Still yet another object of the present invention is to provide a tool pouch frame for supporting a tool pouch in an upright position and holding tools. This makes it possible to removably attach tools to the frame.

An additional object of the present invention is to provide a tool pouch frame for supporting a tool pouch in an upright position and holding tools. This ensures that a tool pouch cannot fall over and spill its contents.

A further object of the present invention is to provide a tool pouch frame for supporting a tool pouch in an upright position and holding tools. This improves the users ability to view the contents of a tool pouch.

A still further object of the present invention is to provide a tool pouch frame for supporting a tool pouch in an upright position and holding tools. This maximizes the storage capacity of a tool pouch.

A yet additional object of the present invention is to provide a tool pouch frame for supporting a tool pouch in an upright position and holding tools. This provides a tool pouch with a carrying handle.

Lastly, it is an object of the present invention to provide a new and improved tool pouch frame for supporting a tool pouch in an upright position and holding tools.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

Figure 1:
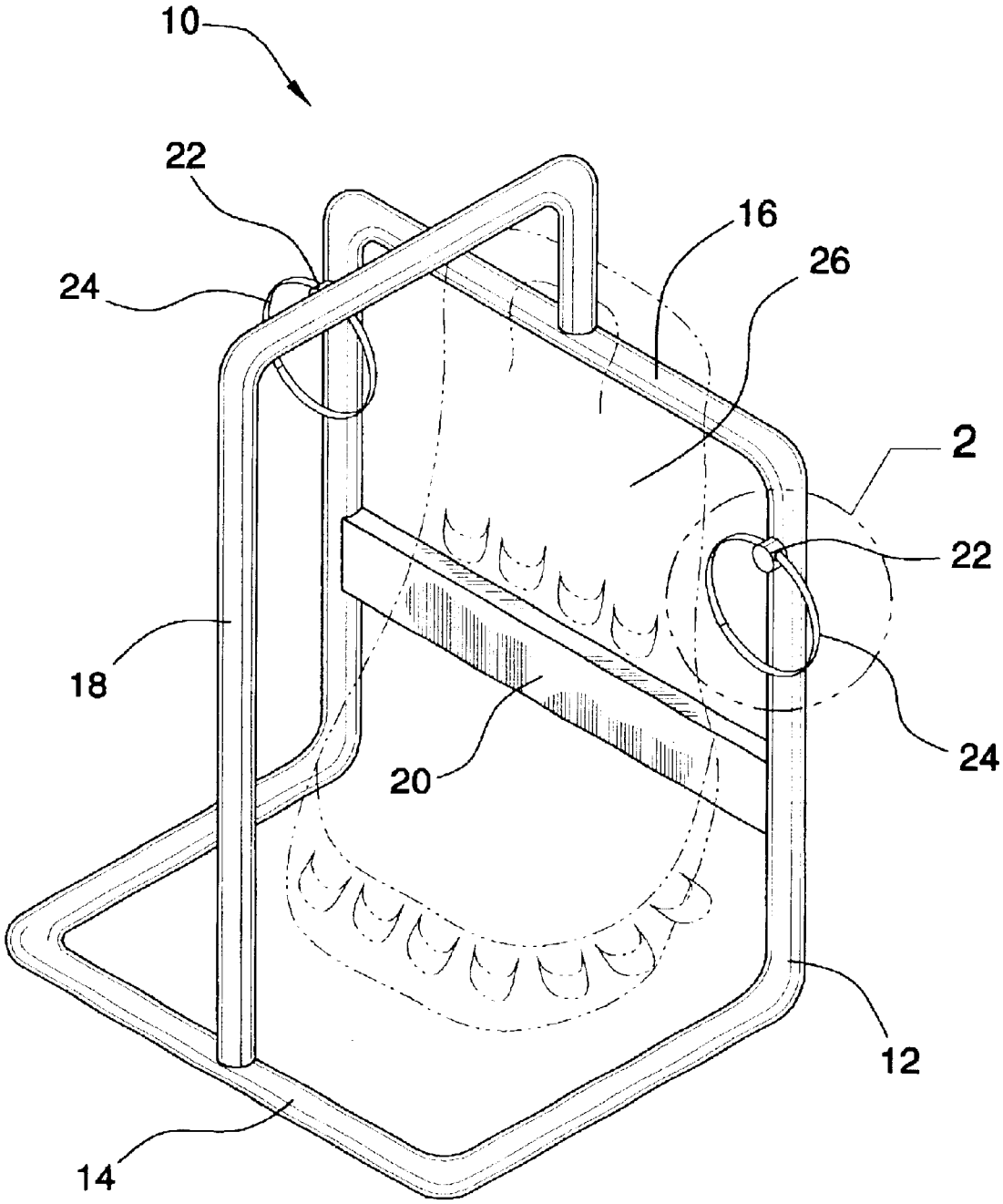
FIG. 1 is a top perspective view of the current embodiment of the tool pouch frame constructed in accordance with the principles of the present invention.
Figure 2:
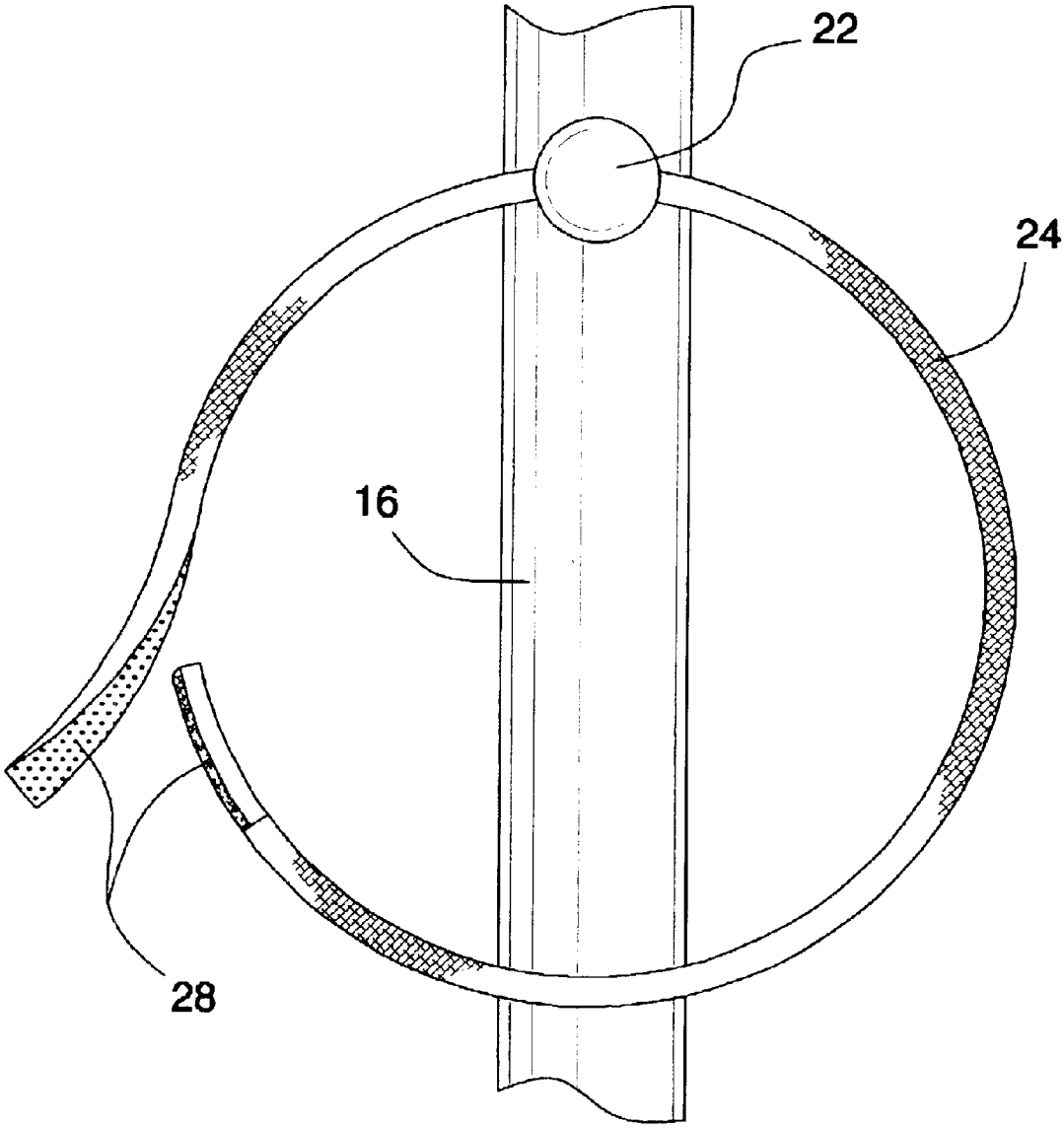
FIG. 2 is a side perspective view of the ring of the present invention.

Referring now to the drawings, and particularly to FIGS. 1–2, a current embodiment of the tool pouch frame of the present invention is shown and generally designated by the reference numeral 10.

In FIG. 1, a new and improved tool pouch frame 10 of the present invention for supporting a tool pouch in an upright position and holding tools is illustrated and will be described. More particularly, the tool pouch frame 10 has a frame 12 enclosing a tool pouch 26. Frame 12 comprises a U-shaped base 14 with its opposing ends connected to the opposing ends of a U-shaped upright member 16. A front member 18 in the shape of an inverted J has one end connected to the middle of base 14 and its opposing end connected to the middle of upright member 16. A lateral support 20 has its opposing ends connected to the opposing sides of upright member 16. One end of front member 18 is inserted through the top of tool pouch 26 prior to being attached to the upright member 16 to removably secure frame 12 to tool pouch 26. The base 14, upright member 16, and front member 18 are made of ⅝-inch diameter plastic tubing in the current embodiment. The lateral support 20 is made of plastic and has a width of ½ inch and a height of ⅛ inch in the current embodiment. Ring attachments 22 are mounted on either side of upright member 16. Rings 24 are held by ring attachments 22. Rings 24 are used to hold additional tools in a convenient location. The base 14 prevents the tool pouch 26 from falling over and spilling its contents. The front member 18 provides a convenient carrying handle for tool pouch 26. Note that the broken lines illustrating tool pouch 26 are for illustrative purposes only and are not part of the current invention.

Concluding with FIG. 2, a new and improved ring 24 of the present invention for supporting a tool pouch in an upright position and holding tools is illustrated and will be described. More particularly, the ring 24 is mounted on ring attachment 22. Ring attachment 22 is connected to the side of upright member 1*b*. Hook and loop fastener 28 removably connects the opposing ends of ring 24. The ends of ring 24 can be disconnected and then closed about a tool (not shown) using hook and loop fastener 28.

In use, it can now be understood that front member 18 is inserted through the top of the tool pouch 26 prior to its attachment to upright member 16 and is used to removably secure the tool pouch 26 to frame 12. Additional tools can be attached to frame 12 using rings 24. Front member 18 provides the tool pouch 26 with a convenient carrying handle, while base 14 holds the tool pouch 26 in an upright position. Lateral support 20 further strengthens frame 12.

While a current embodiment of the tool pouch frame has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as steel, aluminum, titanium, wood, or carbon fiber composite may be used instead of the plastic base, upright member, front member, and lateral support described. Also, the nylon straps may also be made of leather. And although supporting a tool pouch in an upright position and holding tools have been described, it should be appreciated that the tool pouch frame herein described is also suitable for supporting a backpack.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool pouch frame comprising:

a base having opposing ends and a middle;

an upright member having opposing ends, opposing sides, a top, and a middle with said opposing ends connected to said opposing ends of said base; and a front member having opposing ends and a middle with one end connected to said middle of said base and said opposing end connected to said middle of said upright member, wherein said front member is in the shape of an inverted J.

2. A tool pouch frame comprising:

a base having opposing ends and a middle;

an upright member having opposing ends, opposing sides, a top, and a middle with said opposing ends connected to said opposing ends of said base; and a front member having opposing ends and a middle with one end connected to said middle of said base and said opposing end connected to said middle of said upright member;

a plurality of ring attachments connected to said opposing sides of said upright member; and a plurality of rings having opposing ends mounted on said ring attachments; wherein said opposing ends of said rings are removably connected by ring end connection devices.

3. The tool pouch frame as defined in claim 2, wherein said ring end connection devices are hook and loop fasteners.

4. A tool pouch frame comprising:

a hollow base having opposing ends and a middle;

a hollow upright member having opposing ends, opposing sides, a top, and a middle with said opposing ends connected to said opposing ends of said base;

a hollow front member having opposing ends with one end connected to said middle of said base and said opposing end connected to said middle of said upright member;

a plurality of ring attachments connected to said opposing ends of said upright member, a plurality of rings having opposing ends mounted on said ring attachments; and a plurality of hook and loop fasteners removably connecting said opposing ends of said rings.

5. The tool pouch frame as defined in claim 4, wherein said base is U-shaped.

6. The tool pouch frame as defined in claim 4, wherein said upright member is U-shaped.

7. The tool pouch frame as defined in claim 4, wherein said front member is in the shape of an inverted J.

8. The tool pouch frame as defined in claim 4, further comprising a lateral support having opposing ends with said opposing ends connected to said opposing sides of said upright member.

9. In combination with a tool pouch, including an exterior, the improvement which comprises:

a frame having a top, opposing sides, and a bottom enclosing said exterior of said tool pouch;

a plurality of ring attachments connected to said opposing sides of said frame;

a plurality of rings having opposing ends mounted on said ring attachments; and a plurality of hook and loop fasteners removably connecting said opposing ends of said rings.

* * * * *